US012006710B2

(12) United States Patent
Read et al.

(10) Patent No.: US 12,006,710 B2
(45) Date of Patent: Jun. 11, 2024

(54) SUPPORT FOR SUPPORTING A STRUCTURE REGION

(71) Applicant: PERI SE, Weissenhorn (DE)

(72) Inventors: Andrew Read, Ulm (DE); Florian Sturm, Unterroth (DE)

(73) Assignee: PERI SE, Weissenhorn (DE)

( * ) Notice: Subject to any disclaimer, the term of this patent is extended or adjusted under 35 U.S.C. 154(b) by 843 days.

(21) Appl. No.: 16/757,722

(22) PCT Filed: Oct. 22, 2018

(86) PCT No.: PCT/EP2018/078824
§ 371 (c)(1),
(2) Date: Apr. 20, 2020

(87) PCT Pub. No.: WO2019/077155
PCT Pub. Date: Apr. 25, 2019

(65) Prior Publication Data

US 2021/0198911 A1 Jul. 1, 2021

(30) Foreign Application Priority Data

Oct. 20, 2017 (DE) ..... 10 2017 218 783.2

(51) Int. Cl.
*E04G 25/06* (2006.01)
*E04G 3/22* (2006.01)
(Continued)

(52) U.S. Cl.
CPC ..... *E04G 25/061* (2013.01); *E04G 3/22* (2013.01); *E04G 5/16* (2013.01); *E04G 7/307* (2013.01);
(Continued)

(58) Field of Classification Search
CPC ..... E04G 5/16; E04G 11/48; E04G 11/54; E04G 11/56; E04G 25/04; E04G 25/042;
(Continued)

(56) References Cited

U.S. PATENT DOCUMENTS 3,564,803 A 2/1971 Breeze
5,031,724 A * 7/1991 Quinn ..... E04G 25/065 182/186.6
(Continued)

FOREIGN PATENT DOCUMENTS

AU 2008100267 5/2008
DE 2200793 7/1973
(Continued)

*Primary Examiner* — Andrew J Triggs
(74) *Attorney, Agent, or Firm* — SLEMAN & LUND LLP

(57) ABSTRACT

A support for supporting a structure region, including a central part which has a hollow profiled rectangular tube and two end parts, wherein each of the end parts is arranged so as to be telescopable out of the central part from open ends of the hollow profiled rectangular tube in order to change the length of the support. Each of the end parts has a hollow profiled round tube, and inner wall regions of the hollow profiled rectangular tube form guides for the hollow profiled round tubes. The hollow profiled round tubes can be guided in the central part in the longitudinal direction of the hollow profiled rectangular tube by means of contact region lying against the guides so as to achieve the telescopability of the end parts.

17 Claims, 4 Drawing Sheets

(51) Int. Cl.

| | |
|---|---|
| ***E04G 5/16*** | (2006.01) |
| ***E04G 7/30*** | (2006.01) |
| ***E04G 11/48*** | (2006.01) |
| ***E04G 11/56*** | (2006.01) |
| ***E04G 25/04*** | (2006.01) |

(52) U.S. Cl.
CPC ..... *E04G 11/48* (2013.01); *E04G 11/56* (2013.01); *E04G 25/04* (2013.01)

(58) Field of Classification Search
CPC ..... E04G 25/06; E04G 25/061; E04G 25/063; E04G 25/08; E04G 3/22; E04G 7/307
See application file for complete search history.

(56) References Cited

U.S. PATENT DOCUMENTS

| | | | | |
|---|---|---|---|---|
| 5,240,089 | A | 8/1993 | Spera | |
| 5,819,482 | A * | 10/1998 | Belke | E04G 25/06 248/354.3 |
| 7,275,731 | B1 * | 10/2007 | Shinault | E04G 25/06 248/354.5 |
| 2004/0211147 | A1 | 10/2004 | Vanagan | |
| 2008/0244996 | A1 * | 10/2008 | Gillespie | E04G 25/061 52/169.9 |
| 2021/0198911 | A1 * | 7/2021 | Read | E04G 11/48 |

FOREIGN PATENT DOCUMENTS

| | | |
|---|---|---|
| DE | 9309587 | 9/1993 |
| EP | 0408209 | 1/1991 |
| WO | 2006021085 | 3/2006 |

* cited by examiner

SUPPORT FOR SUPPORTING A STRUCTURE REGION

FIELD OF THE INVENTION

The invention relates to a support for supporting a region of a structure, comprising a central part which has a hollow profiled rectangular tube and comprising two end parts, each of the end parts being arranged so as to be able to telescope out of the central part from open ends of the hollow profiled rectangular tube in order to change the length of the support. Supports of this kind are also referred to as telescopic uprights and are often height adjustable heavy load supports for distributing vertical loads into temporary load-bearing frames. The end parts are telescoped out of the central part or inserted into the central part in order to adjust the height of the supports. Such supports are used in particular in the field of tunnel formwork, in order to transfer fresh concrete loads of ceiling formworks into the ground.

BACKGROUND OF THE INVENTION

DE 000009309587 U1 discloses a generic support, the end parts being formed by spindles and the spindles being guided into retainers which are mounted on the open ends of the hollow profiled rectangular tube. A disadvantage thereof is that buckling moments which occur act on the mounting regions of the retainers in a locally limited manner, as a result of which the stability of the support is weakened in these regions. Furthermore, spindle devices for adjusting height are costly to produce.

Supports for supporting regions of structures are also known from practice, in which supports two hollow profiled rectangular tubes which are designed as rectangular hollow profiles are inserted into one another as an inner tube and an outer tube to change the length of the supports. Telescopic uprights of this kind can telescope on one side. Rectangular hollow profiles are designed to be solid in comparison with round tube profiles, which leads to supports of this kind being very heavy and relatively expensive to produce.

SUMMARY OF THE INVENTION

The problem addressed by the invention is therefore that of providing a support for supporting a region of a structure, which support reduces the disadvantages of the prior art, with in particular improved statics of the support with regards to the buckling moment load being intended to be achieved in a lightweight design.

This problem is solved according to the invention by a device according to the present application. Advantageous developments of the invention are specified in the dependent claims and in the description.

In a support according to the invention for supporting regions of structures, which support comprises a central part, which has a hollow profiled rectangular tube, and two end parts, each of the end parts being arranged so as to be able to telescope out of the central part from open ends of the hollow profiled rectangular tube in order to change the length of the support, the end parts each have a hollow profiled round tube. According to the invention, inner wall regions of the hollow profiled rectangular tube form guides for the hollow profiled round tubes, the hollow profiled round tubes being guidable in the central part in the longitudinal direction of the hollow profiled rectangular tube by means of contact regions of said round tubes that abut the guides, in order for the end parts to be able to telescope.

In a support according to the invention, two round hollow profiles, i.e. hollow profiles which have a (circular) round cross section, in the form of hollow profiled round tubes of the end parts (telescopic tubes) are combined with a particularly rectangular hollow profile, i.e. a hollow profile which in particular has a rectangular cross section, in the form of a hollow profiled rectangular tube which forms the central part. The preferably identically designed round hollow profiles are in this case telescopic tubes, which are inserted from both sides into the open ends of the rectangular hollow profile which forms a central tube. The guides for the inner wall regions of the hollow profiled rectangular tube that form the hollow profiled round tubes, on which guides, in order for the end parts to be able to telescope, the hollow profiled round tubes are guidable in the central part in the longitudinal direction of the hollow profiled rectangular tube by means of contact regions which abut the guides, are arranged in two overlapping regions of the hollow profiles. The guides and the contact regions can absorb buckling moments over the entire (combined) length thereof and make a statically highly resilient support possible as a result. Locking the length of the hollow profiles with respect to one another can in this case be carried out, for example, by means of positioning pins which can be inserted into pin holes.

As a result of said combination according to the invention of a plurality of hollow profiles and the positioning of said profiles having two overlapping regions, a very affordable static system is formed by the support according to the invention. The maximum material cross section is in the region of the hollow profiled rectangular tube. The region of the highest buckling moment load, which occurs in the centre of the support, is also in the same location. The regions which have a lower buckling moment load at the start and end of the support have reduced cross sections with the round tube cross sections. Round tubes have a higher static load-bearing capacity in respect of bearing stresses of the aforementioned pin holes than equivalent rectangular tubes. As a result, bore diameters of the pin holes and pin diameters of the length locking mechanism can have smaller dimensions, in particular in the overlapping regions, i.e. at points where the central part and end parts connect.

As such, a telescopic upright according to the invention can have a lighter design while having a higher load bearing capacity and can therefore be produced for a lower cost in relation to the prior art. The reduced mass of the support is beneficial both for handleability and for operational safety when handling the support. In addition, the support according to the invention, i.e. the telescopic upright, is a flexible solution for supporting structures, in particular carcasses, e.g. tunnel carcasses. The support can be flexibly used, i.e. reused, in different structures, with the couplable, i.e. telescopic, support segments of the end parts making possible a simple height adjustment which has a very large adjustment increment that does not require an additional spindle device.

The contact regions are particularly advantageously (directly) formed by outer wall regions, i.e. by outer lateral surface regions, of the hollow profiled round tubes. The inner wall regions or inner surface regions of the hollow profiled rectangular tube that form the guides are in direct contact with the outer wall regions of the hollow profiled round tubes in this case. In this embodiment, the hollow profiled round tubes have an outer diameter which substantially corresponds to the minimum inner diameter of the hollow profiled rectangular tube. Substantially is to be understood in this case as meaning that the diameters correspond to one another except for a clearance which is necessary for the telescoping movement. In other words, each of the round tube profiles abuts the hollow profiled rectangular tube in a sliding-clearance form fit over the relevant insertion length of said round tube profiles in the hollow profiled rectangular tube. It is self-evident that the round tube profiles and the hollow profiled rectangular tube correspondingly have to be exactly calibrated. In this manner, particularly long contact regions are formed. Buckling moments can be absorbed particularly well as a result.

The hollow profiled round tubes can be designed to be non-threaded for a low cost. The hollow profiled rectangular tube can advantageously have a square or rectangular cross section, as a result of which hollow profiled rectangular tubes which are available on the market for a low cost can be used as the central part of the support.

If the lengths of the hollow profiled round tubes are each 30% to 50% of the length of the hollow profiled rectangular tube, maximum possible lengthening of the support according to the invention is made possible by telescoping out the end parts.

If the material thickness, i.e. the wall thickness, of the walls of the round tube profiles is greater than the material thickness of the walls of the hollow profiled rectangular tube, the load bearing capacity of the support according to the invention is distributed evenly over the entire length thereof. The hollow profiled rectangular tube can also have a greater wall thickness than the hollow profiled round tubes, since the greatest buckling moment load occurs in the region of the central part.

Fall-out securing means are particularly advantageously provided on the open ends of the hollow profiled rectangular tube and on the ends of the end parts that are on the side of the central part, the fall-out securing means captively holding the end parts in the central part. As a result, it is made easier to install the supports according to the invention in a structure.

According to a particularly preferred embodiment, the fall-out securing means on the end parts each have a spring pin which is resiliently arranged in a sleeve, and each have an end panel which closes an open end of the hollow profiled rectangular tube, each of the end panels forming a stop for the spring pins. Spring pins of this kind make it possible to disassemble the support according to the invention simply, as a result of which the cleaning of the support, for example, is also simplified.

According to the invention, the inner wall regions of the hollow profiled rectangular tube that form the guides can have a guide groove for the spring pins that extends in the longitudinal direction of the hollow profiled rectangular tube. Said groove is particularly advantageous when the hollow profiled round tubes have an outer diameter which substantially corresponds to the minimum inner diameter of the hollow profiled rectangular tube. This therefore prevents a position from arising during a rotation of the end parts in the central part, in which position the end parts can inadvertently fall out of the central part. The spring pins are preferably arranged in the hollow profiled rectangular tube so as to extend diagonally. This means that the spring pins project into cavities which are present at the edges of the hollow profiled rectangular tube, between the hollow profiled rectangular tube and the relevant hollow profiled round tube. In this manner, said springs can securely hold the end parts in the central part by stopping against an end panel.

Length locking means are advantageously provided, it being possible to secure the end parts to the central part in (different) telescoped positions using the length locking means.

According to the invention, the length locking means can have positioning holes in the hollow profiled round tubes and/or in the hollow profiled rectangular tube, which positioning holes are spaced apart from one another in the longitudinal direction of the hollow profiled rectangular tube, positioning pins being provided to secure the telescoped position. In this manner, a high level of flexibility in respect of the length adjustment of the support according to the invention is achieved. The positioning pins can be arranged such that they are captively held on the support by a flexible holding means, for example a chain or a textile strap.

By means of the round tube design, the telescopic tubes are rotatably mounted in the rectangular central part. The telescopic tubes can therefore not only be positioned by a parallel lateral surface of the hollow profiled rectangular tube, which is designed as a rectangular tube, for example, but also by two faces which have a varying bore pattern. Since two telescopic tubes are already present, this results in a multiplication of the positioning options. In this manner, a very fine adjustment increment of 31.25 mm, for example, can be designed when the hole spacings have a sufficient load bearing capacity, which increment is particularly advantageous in the field of tunnel building.

The spacings between the positioning holes for securing the telescoped positions of one of the end parts can differ from the spacings between the positioning holes for securing the telescoped positions of the other end part.

Connecting means, in particular connecting flanges, for support system components are provided on the free ends of the end parts and/or on the central part. An extensive support frame can be assembled as a support system using said connecting means of this kind. The use of round hollow profiles in the steel construction of tunnel formwork carriages, for example, is thereby made possible while avoiding the difficult soldering operation of attaching standard connections to round hollow profiles.

The support according to the invention can in particular be designed as a heavy load support, the support having a load bearing capacity of more than 200 kilonewtons.

The support according to the invention is used as a load-bearing support in a structure. Said structure can be in particular a carcass, e.g. a tunnel carcass. In this case, the support is in particular arranged to support a ceiling construction region of the structure.

Further advantages of the invention can be found in the description and the drawings. According to the invention, the features which are previously mentioned and explained in greater detail can each be used alone or together in any combination. The embodiments which are shown and described are not to be understood as a definitive list, but rather have an exemplary nature for describing the invention.

BRIEF DESCRIPTION OF THE DRAWINGS

Particular embodiments of the present invention are explained below in greater detail with reference to the accompanying drawings, in which.

DETAILED DESCRIPTION

Figure 1A:
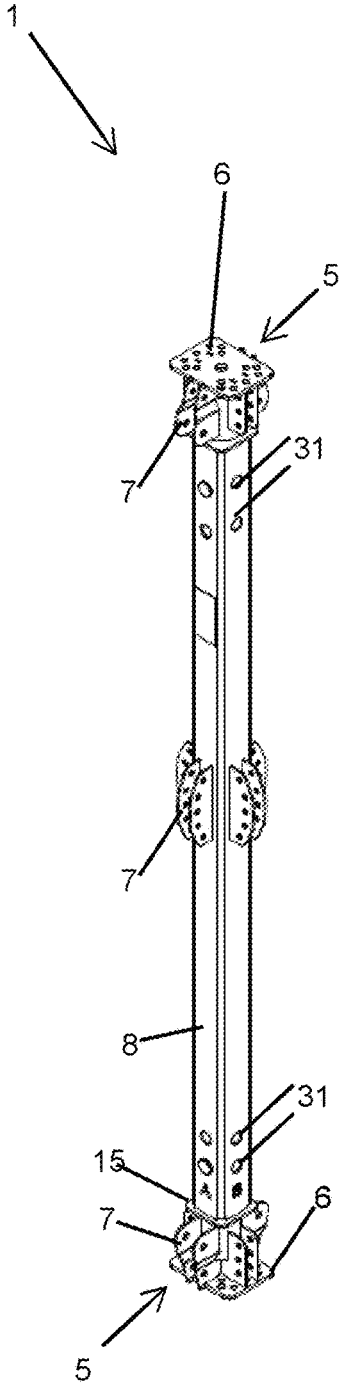
FIG. 1*a* shows a perspective view of the support according to the invention, in which the hollow profiled round tubes are completely retracted.
Figure 1B:
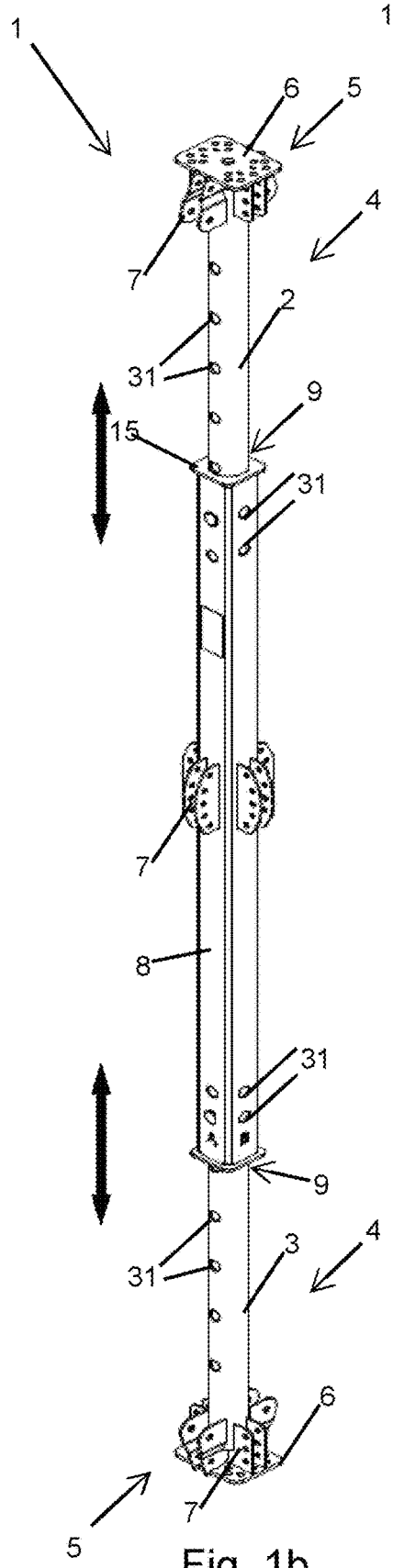
FIG. 1*b* shows a perspective view of the support according to the invention, in which the hollow profiled round tubes are completely extended.
Figure 1C:
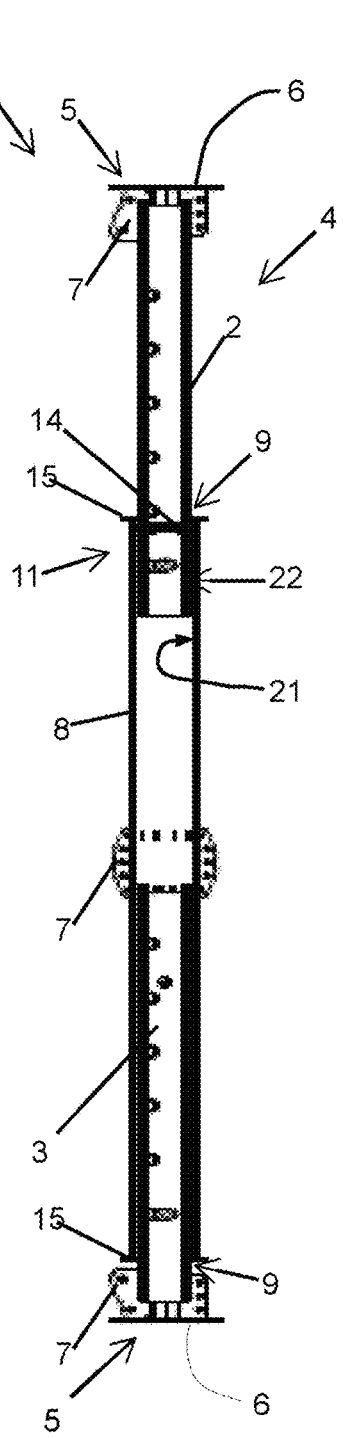
FIG. 1*c* shows a longitudinal section of the support according to the invention, in which one hollow profiled round tube is retracted as far as possible and one hollow profiled round tube is extended as far as possible.

FIG. 1*a* to 1*c* each show a perspective view of the support 1 according to the invention, FIG. 1*a* showing the support 1 having the hollow profiled round tubes 2, 3 completely retracted, and FIG. 1*b* showing the support 1 having the hollow profiled round tubes 2, 3 completely extended. FIG. 1*c* shows the support 1 in a longitudinal section, having one hollow profiled round tube 3 retracted as far as possible and one hollow profiled round tube 2 extended as far as possible. The hollow profiled round tubes 2, 3 each form an end part 4 of the support 1.

The free ends of the end parts 4 are designed as support heads 5 which each have a closing plate 6 and connecting means 7 for support system components that are designed as connecting flanges. Support system components can be transverse connections between a plurality of supports, for example. The support 1 has a central part which has a hollow profiled rectangular tube 8, on which part further connection means 7 of this kind for support system components are provided.

The central part of the support 1 is formed by the hollow profiled rectangular tube 8. The two end parts 4 are each arranged so as to be able to telescope out of the central part from open ends 9 of the hollow profiled rectangular tube 8 in order to change the length of the support 1. For this purpose, the hollow profiled round tubes 2, 3 are inserted into the central part via the open ends 9. This ability to telescope is symbolically shown in the figure by means of double arrows. The hollow profiled rectangular tube 8 of the central part in this case has a square cross section, it being possible for the edges of the hollow profiled rectangular tube 8 to be rounded.

According to FIG. 1*c*, fall-out securing means 11 are provided on the open ends 9 of the hollow profiled rectangular tube 8 and on the ends of the end parts 4 that are on the side of the central part. The fall-out securing means 11 captively hold the end parts in the central part. On each of the end parts 4, the fall-out securing means 11 have a pin 14 and an end panel 15 which closes an open end 9 of the hollow profiled rectangular tube 8, which pin and panel are rigidly connected, e.g. soldered, to the hollow profiled rectangular tube 8. Each one of the pins 14 is fed through an associated hollow profiled round tube 2, 3, perpendicularly to the longitudinal axis of the associated hollow profiled round tube 2, 3. The end panels 15 each form a stop for the pins 14. This means that each end panel 15 forms a stop for the pin 14 which is fed through the hollow profiled round tube 2, 3 which is inserted into the open end 9 of the central part that is closed by the end panel 15.

The depth stop for the hollow profiled round tube 3 which is retracted as far as possible is apparent in FIG. 1*c*. As part of the fall-out securing means 11 of the hollow profiled round tube 2 which is extended as far as possible, a spring pin 14 that stops on the end panel side, for example, is also shown. In FIG. 1*c* it is clearly apparent, due to the longitudinal sectional view, that inner wall regions 21 of the hollow profiled rectangular tube 8 form guides for the hollow profiled round tubes 2, 3. In this case, the hollow profiled round tubes 2, 3 can be guided in the longitudinal direction of the hollow profiled rectangular tube 8 by means of contact regions 22 in the end parts 4 that abut the guides, in order for the end parts 4 to be able to telescope in the sliding-clearance form fit. The contact regions 22 are formed by outer wall regions of the hollow profiled round tubes 2, 3. The inner wall regions 21 of the hollow profiled rectangular tube 8 that form the guides in this case directly contact the outer wall regions of the hollow profiled round tubes 2, 3, which contact is shown in the figure by the spacing between the inner wall regions 21 of the hollow profiled rectangular tube 8 and the outer wall regions of the hollow profiled round tubes 2, 3, which spacing is only marked in a limited manner. The hollow profiled round tubes 2, 3 each have an outer diameter which substantially corresponds to the minimum inner diameter of the hollow profiled rectangular tube 8. Substantially is to be understood in this case as meaning that the diameters correspond to one another except for a clearance which is necessary for the telescoping movement. The guides and contact regions 22 at least partially touch, at least during heavy loads of the support 1, in order to absorb bending moments that occur as a result.

The lengths of the hollow profiled round tubes 2, 3 are each 30% to 50% of the length of the hollow profiled rectangular tube 8. The material thickness of the walls of the hollow profiled round tubes 2, 3 is greater than the material thickness of the walls of the hollow profiled rectangular tube 8, which also corresponds to the line thickness of the hollow profiled round tubes 2, 3 and the hollow profiled rectangular tube 8 in FIG. 1*c*.

In order to lock the (extension) length of the support 1 when telescoping the end parts 4, length locking means are provided on the support 1. The end parts 2, 3 can be secured to the central part in telescoped positions by means of the length locking means. The length locking means have positioning pins and positioning holes 31. The positioning holes 31 of the length locking means are arranged spaced apart from one another in the longitudinal direction of the hollow profiled rectangular tube 8 and can in particular be bored into the hollow profiled round tubes 2, 3 and into the hollow profiled rectangular tube 8. This means that the positioning holes 31 are formed by bores through the walls of the hollow profiled round tubes 2, 3 and in the hollow profiled rectangular tube 8, the positioning pins for securing the telescoped positions being fed through the bores. The spacings of the positioning holes 31 for securing the telescoped positions of one of the end parts 4 differ from the spacings of the positioning holes 31 for securing the telescoped positions of the other end part 4. In the figure, the positioning holes 31 in the region of the open end 9 of the central part that is at the top in the figure have a slightly smaller spacing than the positioning holes 1 in the region of the open end 9 of the central part that is at the bottom in the figure. Variable total lengths of the support 1 can be achieved by correspondingly securing the end parts 4 by positioning using the pins.

Figure 2A:
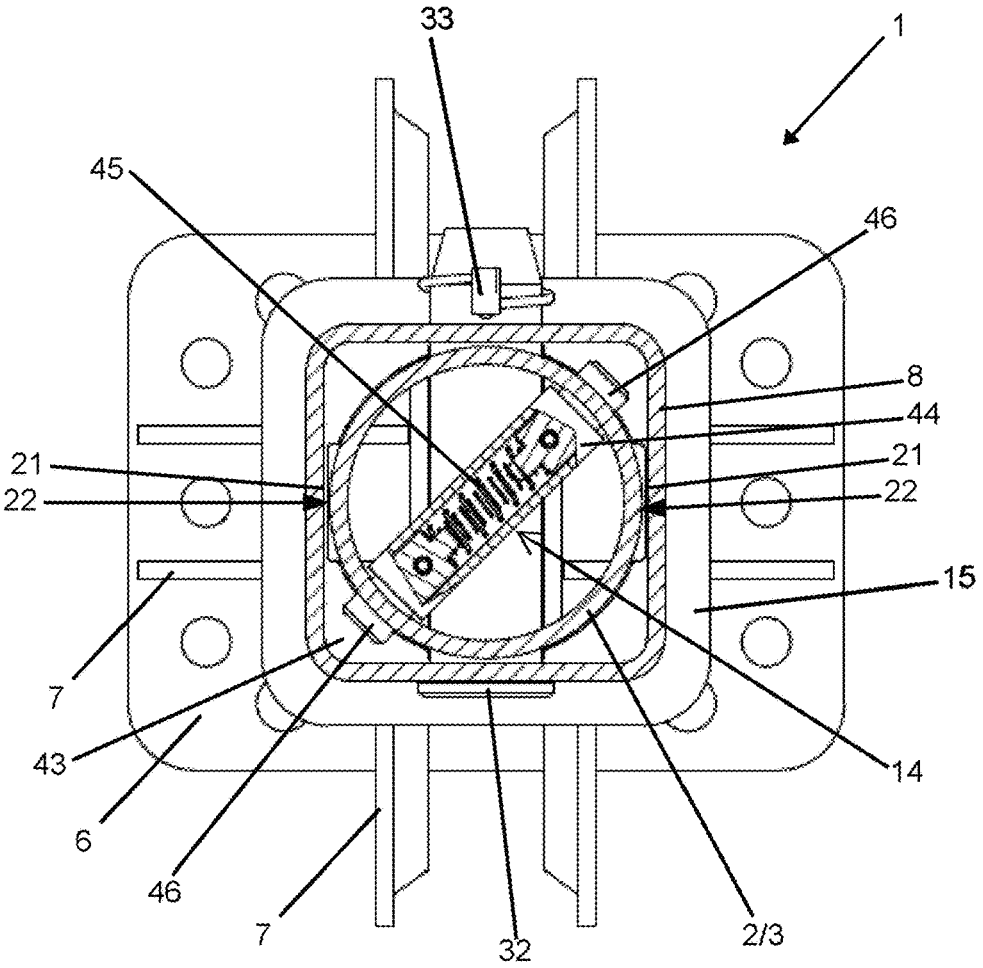
FIG. 2*a* shows a cross-sectional view of the fall-out securing means of the support having a partial view of a spring pin of the fall-out securing means.
Figure 2B:
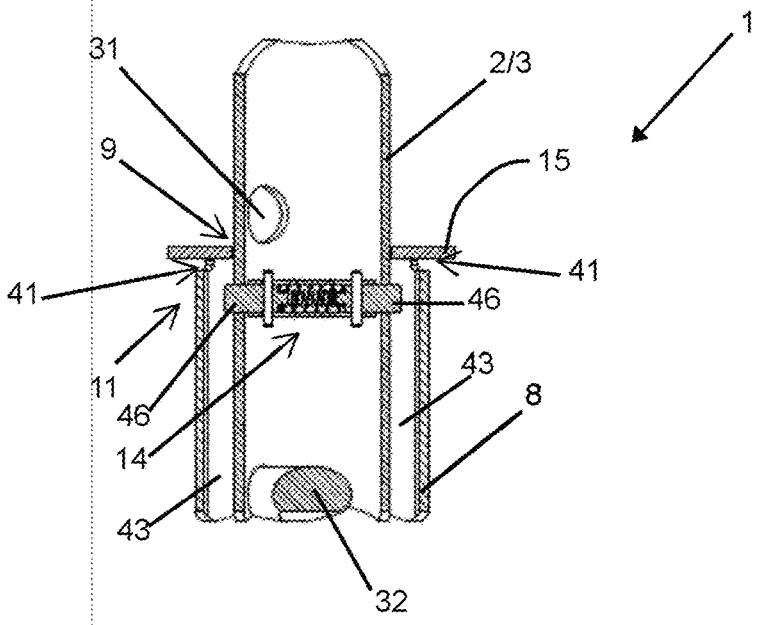
FIG. 2*b* shows a detailed longitudinal section of the support, corner recesses of the hollow profiled rectangular tube which forms the central part being apparent near the end panel, by means of which recesses the fall-out securing means can be moved into an unlocked position.

FIGS. 2*a* and 2*b* each show in detail the support 1 according to the invention, in the region of the fall-out securing means (fall-out securing means region) 11 of an end part of the support 1. FIG. 2*a* in this case shows a cross-sectional projection of the fall-out securing means region that has a partial view of a spring pin 14 of the fall-out securing means 11. The support head 5 of the end part is also shown together with the closing panel 6 and the connecting flanges 7 thereof, and the connecting flanges 7 of the central part. A positioning pin 32, which is fed through the positioning holes 31, is also shown having a splint securing device 33.

As a result of the clearance of the spring pins 14, it is also evident in FIG. 2*a* that the hollow profiled round tubes 2, 3 of the end parts which form the telescope tube are rotatably mounted directly in the hollow profiled rectangular tube 8 of the central part. The inner wall regions 21 of the hollow profiled rectangular tube 8 that form guides for the hollow profiled round tubes 2, 3 and the single shown hollow profiled rectangular tube are formed by the central regions of the surfaces of the inner faces of the hollow profiled rectangular tube 8. In this case, the hollow profiled round tubes 2, 3 are guided in the central part, i.e. in the hollow profiled rectangular tube 8, in the longitudinal direction of the hollow profiled rectangular tube 8 by means of contact regions 22 which abut the guides, in order for the end parts 4 to be able to telescope. Said contact regions 22 are formed by the outer wall regions of the hollow profiled round tubes 2, 3. The inner wall regions 21 of the hollow profiled rectangular tube 8 that form the guides are in direct contact with the outer wall regions (=lateral surface regions) of the hollow profiled round tubes 2, 3 in this case. In this context, the outer diameter of the hollow profiled round tubes 2, 3 substantially corresponds to the minimum inner diameter of the hollow profiled rectangular tube 8, which, in the case of a square hollow profiled rectangular tube 8, corresponds to the length of the inner edge of the hollow profiled rectangular tube 8.

FIG. 2*b* shows a longitudinal section of the fall-out securing means region of the support, corner recesses 41 of the hollow profiled rectangular tube 8 which forms the central part being apparent near the end panel, by means of which recesses the fall-out securing means 11 can be moved into an unlocked position. The figure shows that the fall-out securing means 11 on the end parts each have a pin designed as a spring pin 14, and each have an end panel 15 which closes an open end 9 of the hollow profiled rectangular tube 8. Each of the end panels 15 forms a stop for the spring pins 14. The spring-loaded fall-out securing means 11 of this kind allow the hollow profiled round tubes 2, 3, which are the telescopic tubes, of the end parts in the central part to rotate freely, the end panels 15 of the central part forming the stops for the spring pins 14 which are the securing pins.

The spring pins 14 are arranged in the hollow profiled rectangular tube 8 so as to extend diagonally, i.e. said pins extend diagonally from one edge of the hollow profiled rectangular tube 8 to a relevant opposite edge of the hollow profiled rectangular tube 8, and are perpendicular to the longitudinal axis of the support. As a result, the spring pins 14 project into cavities 43 which are present at the edges of the hollow profiled rectangular tube 8, between the hollow profiled rectangular tube 8 and the hollow profiled round tube 2, 3. The spring pins 14 are each arranged resiliently in a sleeve 44. In this case a helical spring 45 is arranged between two parts 46 of the spring pin 14 along the longitudinal axis of the sleeve 44. In this manner the helical spring 45 presses the parts 46 of the spring pin 15 out of the sleeve 44 in the longitudinal axis direction of the sleeve 44. By pressing together the parts 46 of the spring pin 14 into the sleeve 44, the end parts can be unlocked. This unlocked position can be achieved by engaging in the shown corner recesses (disassembly recesses) 41 of the hollow profiled rectangular tube 8 which forms the central part, which recesses are near the end panel. The fall-out securing means region 11, together with the length locking means, forms a means which reliably secures against crushing or falling out.

Figure 3:
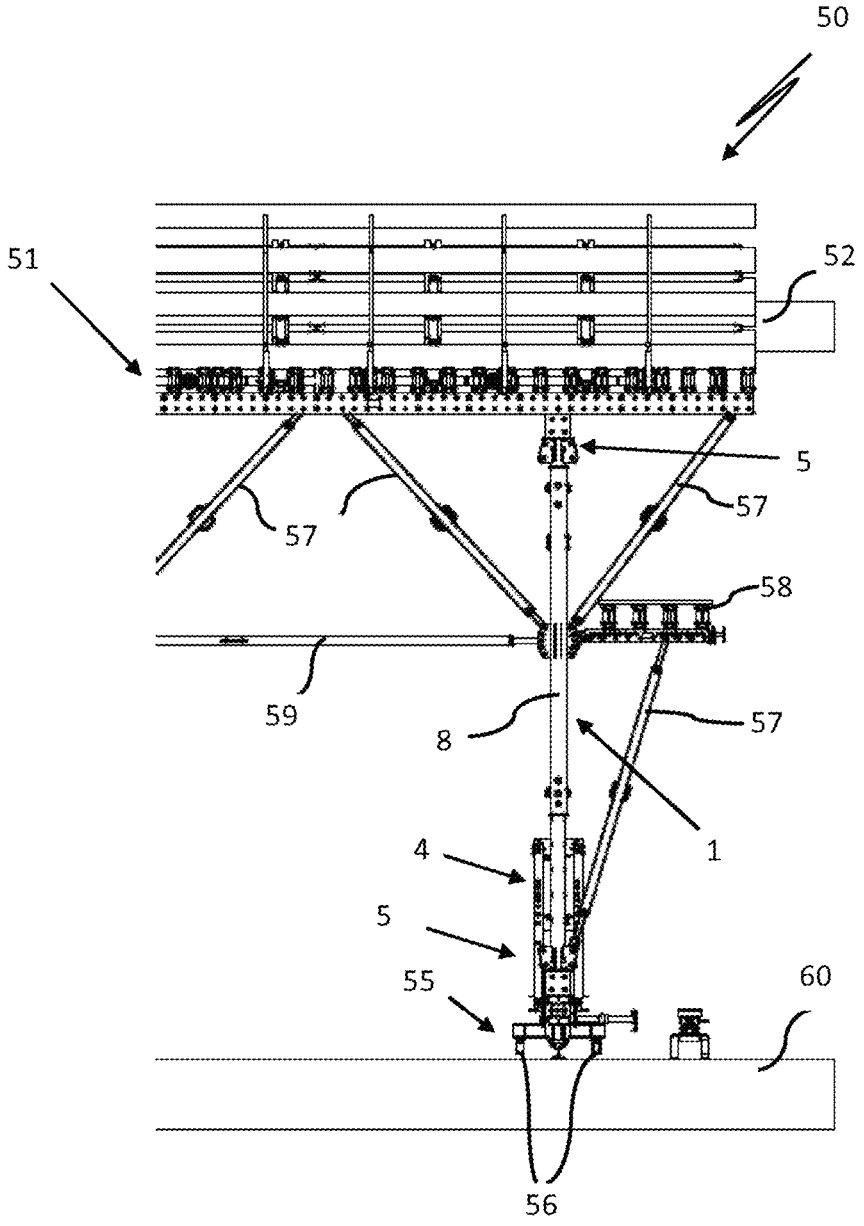
FIG. 3 shows a view of a structure which has a support according to the invention.

FIG. 3 shows a structure region of a structure which is designated as a whole with the reference numeral 50 and has a support 1 according to the invention, the support 1 being arranged to support a ceiling construction region 51 of the structure 50. The structure 50 is a carcass, for example, in particular a tunnel carcass. The support 1 is in this case used for supporting a ceiling construction region 51, which has a ceiling formwork and a concrete ceiling 52 of the structure 50 that is (still) encased by the ceiling formwork. The support 1 is mounted on a rolling construction 55 which is set on rails 56. A tunnel formwork carriage is created in this manner. The support 1 transfers the vertical load of the ceiling formwork and the concrete ceiling 52 into the floor, in this case the already concreted tunnel floor 60, via the rolling construction 55 and the rails 56.

In the figure, the upper end part of the support 1 is not telescoped out of the hollow profiled rectangular tube 8 of the central part, whereas the lower end part 4 of the support 1 is telescoped out of the central part as far as possible. Further support system components are mounted on the central part of the support 1 and on the in particular lower support head 5 thereof by means of connecting flanges 7, i.e. pieces of sheet steel which are soldered to the support heads and/or to the central part and are provided with screw holes. In this case, for example, said support system components are diagonal reinforcements 57, e.g. corner connectors, heavy load spindles 58 and/or horizontal struts 59 for horizontally connecting two supports 1 according to the invention, for example, via the central part thereof so as to reinforce them. By means of this plurality of connection options of the support 1 according to the invention, which is designed as a heavy load support, a modular construction system for a support system, such as a tunnel formwork carriage, is made.

As a result of the high level of flexibility of the support 1 according to the invention and the fine length adjustment (adjustment increment) thereof, for example of an extension length (maximum total length or height) of 4000 mm to a maximum of 6500 mm in adjustment increments of 31.25 mm, all tunnel cross sections within the range of the maximum total length or height of the support can be replicated, i.e. supported. A fine adjustment in the remaining range of 31.25 mm can be carried out using lowering wedges arranged underneath the tunnel formwork carriage. No additional, costly spindle devices are therefore necessary for precise height adjustment for the heavy load region. The adjustability of the lowering wedges is sufficient. The support 1 according to the invention is therefore a height-adjustable heavy load support for transferring vertical loads into temporary load-bearing frames, which support can be used flexibly. In addition to the flexible height adjustment and light construction thereof, the telescopic upright according to the invention is characterised by a high load bearing capacity of e.g. 250 kilonewton, while having a relatively low self-weight of e.g. 288.8 kg. It is correspondingly a very advantageous static system. The light construction is achieved using smaller material cross sections, i.e. wall thicknesses, in comparison to conventional supports. The support according to the invention also offers a plurality of connecting and fastening options, e.g. for braces, platforms, reinforcements and/or load bearers, which makes it an ideal supplementary component of a modular construction system. In this case it is possible to make modifications quickly, e.g. for adapting to heights, in ongoing building projects, without additional components. In this manner, a telescopic upright is provided for various building projects, in particular tunnel building projects which have varying tunnel cross sections.

Figure 4A:
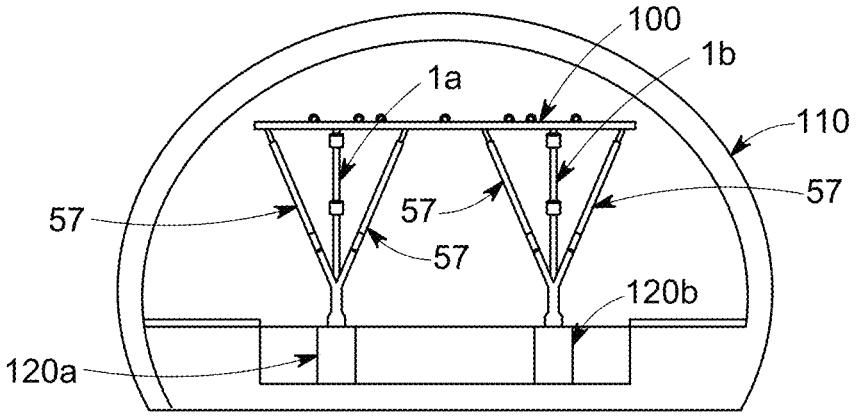
FIG. 4*a-c* show the use of the supports according to the invention in a cross-sectional change in tunnel building.
Figure 4B:
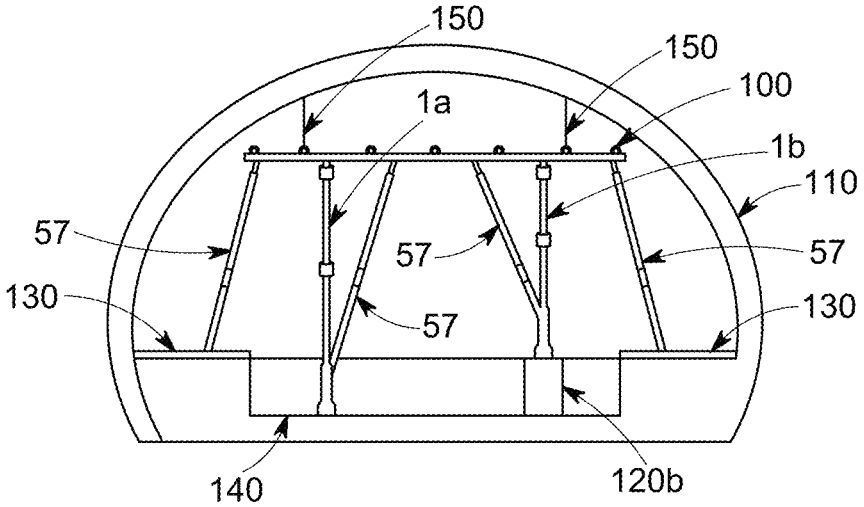
Figure 4C:
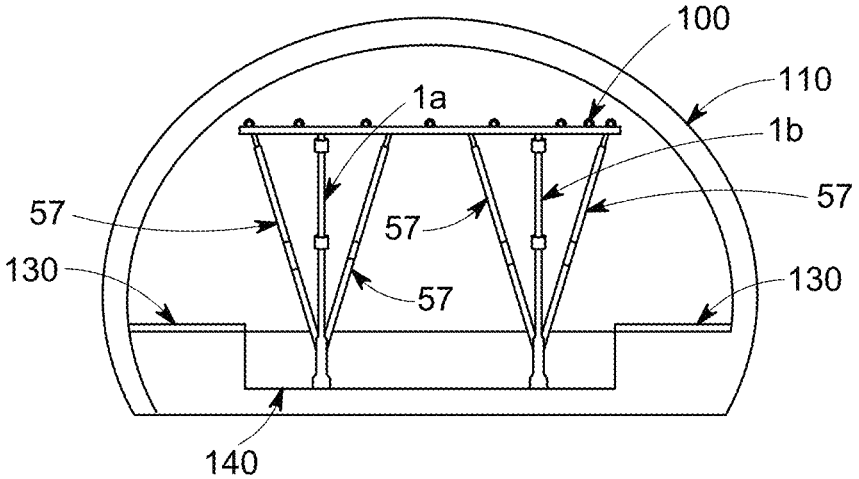

The use of supports according to the invention in tunnel building projects of this kind which have varying tunnel cross sections is shown in an embodiment in sectional views in FIG. 4*a*-4*c*. It is in particular clear in this case how the supports according to the invention can be quickly varied in length while being used in tunnel building projects. FIG. 4*a* shows two supports 1*a*, 1*b* according to the invention, which are used to support a tunnel construction region which has a formwork 100 of a structure 110, which supports are in a starting position, i.e. the respective upper and lower end parts of the two supports 1*a*, 1*b* according to the invention are not telescoped out. The two supports 1*a*, 1*b* transfer the vertical load of the tunnel construction region into the ground via substructures, in this case wooden substructures 120*a*, 120*b*. Two further support system components, diagonal reinforcements 57, are mounted on each of the two supports 1*a*, 1*b*, which components connect the two supports 1*a*, 1*b* and the formwork 100 to one another. In order to then be able to react to a changed tunnel cross section, the two outer reinforcements 57 are then released from the two supports 1*a*, 1*b* and mounted on a fixed edge region 130, as a result of which the tunnel construction region which has the formwork 100 is supported outwardly; see FIG. 4*b*. The wooden substructure 120*a* can therefore be removed, and the upper and lower end part of the support 1*a* can be telescoped out of the central part of the support 1*a* to an extent that the support 1*a* can transfer the vertical load into the ground 140, and therefore be adapted to the changed tunnel cross section. In this embodiment, the formwork 100 is additionally fixed to the ceiling by securing apparatuses 150. Subsequently, the wooden substructure 120*b* of the support 1*b* can also be removed, and the two end parts, as described for the support 1*a*, can be telescoped out. In the last step, the two outer reinforcements 57 are connected to the two supports 1*a*, 1*b* again, and the securing apparatuses 150 are removed, as shown in FIG. 4*c*. As was shown, using supports according to the invention it is possible to react to varying tunnel cross sections quickly and during use, which is not possible using fixed length supports.

The invention claimed is:

1. A support for supporting a region of a structure, comprising a central part which has a hollow profiled rectangular tube having a square or rectangular cross section and comprising two end parts, each of the end parts being arranged so as to be able to telescope out of the central part from open ends of the hollow profiled rectangular tube in order to change a length of the support, wherein the end parts each have a hollow profiled round tube designed to be non-threaded, and inner wall regions of the hollow profiled rectangular tube form guides for the hollow profiled round tubes, the hollow profiled round tubes being guidable in the central part in a longitudinal direction of the hollow profiled rectangular tube by means of contact regions which abut the guides, in order for the end parts to be able to telescope, wherein the lengths of the hollow profiled round tubes are in each case 30 to 50% of the length of the hollow profiled rectangular tube, and for a load bearing capacity of the support to be distributed evenly over an entire length thereof a material thickness of the walls of the hollow profiled round tubes is greater than a material thickness of the walls of the hollow profiled rectangular tube.

2. The support according to claim 1, wherein the contact regions are formed by outer wall regions of the hollow profiled round tubes.

3. The support according to claim 1, wherein fall-out securing means are provided on the open ends of the hollow profiled rectangular tube and on the ends of the end parts that are on the side of the central part, the fall-out securing means captively holding the end parts in the central part.

4. The support according to claim 3, wherein the fall-out securing means on the end parts each have a spring pin which is resiliently arranged in a sleeve, and each of the fall-out securing means have an end panel which closes an open end of the hollow profiled rectangular tube, each of the end panels forming a stop for the spring pins.

5. The support according to claim 4, wherein the inner wall regions of the hollow profiled rectangular tube that form the guides have a guide groove for the spring pins that extends in the longitudinal direction of the hollow profiled rectangular tube, and/or in that the spring pins are arranged in the hollow profiled rectangular tube so as to extend diagonally.

6. The support according to claim 1, wherein length locking means are provided, the end parts being securable to the central part in telescoped positions by means of the length locking means.

7. The support according to claim 6, wherein the length locking means have positioning holes in the hollow profiled round tubes and/or in the hollow profiled rectangular tube, which positioning holes are spaced apart from one another in the longitudinal direction of the hollow profiled rectangular tube, positioning pins being provided to secure the telescoped positions.

8. The support according to claim 7, wherein spacings between the positioning holes for securing the telescoped positions of one of the end parts differ from spacings between the positioning holes for securing the telescoped positions of the other end part.

9. The support according to claim 1, wherein connecting means are provided on the free ends of the end parts and/or on the central part.

10. The support according to claim 9, wherein the connecting means comprises connecting flanges for support system components.

11. The support according to claim 1, wherein the support is designed as a heavy load support having a load bearing capacity of more than 200 kilonewtons.

12. A structure comprising at least one support according to claim 1, wherein the support is arranged to support a ceiling construction region of the structure.

13. The structure according to claim 12, wherein the structure is designed as a temporary structure.

14. The structure according to claim 13, wherein the temporary structure comprises one of formwork or a tunnel formwork carriage.

15. The structure according to claim 12, wherein two or more supports are arranged in the structure.

16. The structure according to claim 15, wherein the two or more supports are arranged in the structure so as to be variable in length.

17. A support for supporting a region of a structure, comprising:

a central part which has a hollow profiled rectangular tube having a square or rectangular cross section; and two end parts, each of the end parts being arranged so as to be able to telescope out of the central part from open ends of the hollow profiled rectangular tube in order to change a length of the support, wherein the end parts each have a hollow profiled round tube designed to be non-threaded, and inner wall regions of the hollow profiled rectangular tube form guides for the hollow profiled round tubes, the hollow profiled round tubes being guidable in the central part in a longitudinal direction of the hollow profiled rectangular tube by means of contact regions which abut the guides, in order for the end parts to be able to telescope, wherein a material thickness of the walls of the hollow profiled round tubes is greater than a material thickness of the walls of the hollow profiled rectangular tube so that a load bearing capacity of the support is distributed evenly over an entire length thereof.

* * * * *